US008483589B2

(12) United States Patent
Uneme et al.

(10) Patent No.: US 8,483,589 B2
(45) Date of Patent: Jul. 9, 2013

(54) DEVELOPING DEVICE, DEVELOPING CARTRIDGE, PROCESS CARTRIDGE AND IMAGE FORMING APPARATUS

(75) Inventors: Tetsushi Uneme, Susono (JP); Shigeo Miyabe, Numazu (JP); Tetsuya Numata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 344 days.

(21) Appl. No.: 12/906,441

(22) Filed: Oct. 18, 2010

(65) Prior Publication Data

US 2011/0103827 A1 May 5, 2011

(30) Foreign Application Priority Data

Oct. 30, 2009 (JP) ..... 2009-250150
Sep. 14, 2010 (JP) ..... 2010-205557

(51) Int. Cl.
*G03G 15/08* (2006.01)
*G03G 21/18* (2006.01)

(52) U.S. Cl.
USPC ..... 399/98; 399/111; 399/119; 399/227; 399/262

(58) Field of Classification Search
USPC ..... 399/98, 110, 111, 119, 120, 252, 399/262, 227
See application file for complete search history.

(56) References Cited

U.S. PATENT DOCUMENTS 5,331,373 A 7/1994 Nomura et al.
5,452,056 A 9/1995 Nomura et al.
5,463,446 A 10/1995 Watanabe et al.
5,585,889 A 12/1996 Shishido et al.
5,640,650 A 6/1997 Watanabe et al.
5,839,028 A 11/1998 Nomura et al.
5,873,012 A 2/1999 Miyabe et al.
5,878,309 A 3/1999 Nomura et al.
5,878,310 A 3/1999 Noda et al.
5,926,666 A 7/1999 Miura et al.
5,943,529 A 8/1999 Miyabe et al.

(Continued)

FOREIGN PATENT DOCUMENTS

JP 06-027795 A * 2/1994
JP 11-338234 A 12/1999

(Continued)

OTHER PUBLICATIONS

Office Action in Chinese Patent Application No. 201010529767.5, mailed Jun. 6, 2012 (with English translation).

(Continued)

*Primary Examiner* — Sophia S Chen
(74) *Attorney, Agent, or Firm* — Fitzpatrick, Cella, Harper & Scinto

(57) ABSTRACT

A developing device is provided that includes a developing container, a developing roller, a developer supplying roller, a sheet member, a communication hole, and a filter member. The communication hole is provided so as to be connected to an enclosed space defined by an inner wall of the developing container defining a smaller one of spaces provided by dividing the developing container by a plane including a rotation axis of the developer supplying roller and a rotational axis of the developing roller, a phantom plane which is included in the plane and extends from a surface of the developer supplying roller to the inner wall of the developer container, the sheet member, a surface of the developing roller, and a surface of the developer supplying roller.

12 Claims, 8 Drawing Sheets

U.S. PATENT DOCUMENTS

| | | | |
|---|---|---|---|
| 5,946,531 | A | 8/1999 | Miura et al. |
| 5,950,047 | A | 9/1999 | Miyabe et al. |
| 5,966,567 | A | 10/1999 | Matsuzaki et al. |
| 6,029,031 | A | 2/2000 | Yokomori et al. |
| 6,064,843 | A | 5/2000 | Isobe et al. |
| 6,072,968 | A | 6/2000 | Nomura et al. |
| 6,128,452 | A | 10/2000 | Miyabe et al. |
| 6,154,623 | A | 11/2000 | Suzuki et al. |
| 6,167,219 | A | 12/2000 | Miyamoto et al. |
| 6,173,140 | B1 | 1/2001 | Suzuki et al. |
| 6,181,897 | B1 | 1/2001 | Kawai |
| 6,215,969 | B1 | 4/2001 | Nomura et al. |
| 6,282,390 | B1 | 8/2001 | Miyabe et al. |
| 6,317,572 | B1 | 11/2001 | Miyabe et al. |
| 6,336,017 | B1 | 1/2002 | Miyamoto et al. |
| 6,351,620 | B1 | 2/2002 | Miyabe et al. |
| 6,415,121 | B1 | 7/2002 | Suzuki et al. |
| 6,519,431 | B1 | 2/2003 | Toba et al. |
| 6,542,706 | B2 | 4/2003 | Toba et al. |
| 6,549,736 | B2 | 4/2003 | Miyabe et al. |
| 6,603,939 | B1 | 8/2003 | Toba et al. |
| 6,678,488 | B2 | 1/2004 | Toba et al. |
| 6,795,666 | B2 | 9/2004 | Miyabe et al. |
| 6,836,629 | B2 | 12/2004 | Miyabe et al. |
| 6,931,226 | B2 | 8/2005 | Chadani et al. |
| 6,934,485 | B2 | 8/2005 | Miyabe et al. |
| 7,136,604 | B2 | 11/2006 | Chadani et al. |
| 7,149,457 | B2 | 12/2006 | Miyabe et al. |
| 7,155,141 | B2 | 12/2006 | Sato et al. |
| 7,158,736 | B2 | 1/2007 | Sato et al. |
| 7,164,875 | B2 | 1/2007 | Miyabe et al. |
| 7,184,690 | B2 | 2/2007 | Ueno et al. |
| 7,212,768 | B2 | 5/2007 | Numagami et al. |
| 7,224,925 | B2 | 5/2007 | Sato et al. |
| 7,248,810 | B2 | 7/2007 | Miyabe et al. |
| 7,315,710 | B2 | 1/2008 | Ueno et al. |
| 7,349,657 | B2 | 3/2008 | Sato et al. |
| 7,412,193 | B2 | 8/2008 | Sato et al. |
| 7,450,877 | B2 | 11/2008 | Miyabe et al. |
| 7,499,663 | B2 | 3/2009 | Sato et al. |
| 7,689,146 | B2 | 3/2010 | Sato et al. |
| 7,702,251 | B2 | 4/2010 | Miyabe et al. |
| 7,711,287 | B2 | 5/2010 | Kimizuka et al. |
| 2005/0163532 | A1* | 7/2005 | Tsuruya et al. ..... 399/119 |
| 2008/0152388 | A1 | 6/2008 | Ueno et al. |
| 2008/0260428 | A1 | 10/2008 | Ueno et al. |
| 2009/0074466 | A1* | 3/2009 | Kwon et al. ..... 399/252 |
| 2009/0317134 | A1 | 12/2009 | Miyabe et al. |
| 2009/0317135 | A1 | 12/2009 | Miyabe et al. |
| 2009/0317138 | A1* | 12/2009 | Kawasaki et al. ..... 399/227 |
| 2010/0054804 | A1 | 3/2010 | Uneme et al. |
| 2010/0054805 | A1 | 3/2010 | Numata et al. |
| 2010/0054806 | A1 | 3/2010 | Ueno et al. |
| 2010/0054807 | A1 | 3/2010 | Takeyama et al. |
| 2010/0054823 | A1 | 3/2010 | Takasaka et al. |
| 2010/0158556 | A1 | 6/2010 | Miyabe et al. |
| 2010/0215401 | A1* | 8/2010 | Fujiwara et al. ..... 399/119 |

FOREIGN PATENT DOCUMENTS

| | | | |
|---|---|---|---|
| JP | 2000-131940 | | 5/2000 |
| JP | 2003-270939 | | 9/2003 |
| JP | 2005-352076 | | 12/2005 |
| JP | 2006-250973 | | 9/2006 |
| JP | 2007-148335 | | 6/2007 |
| JP | 2007-178906 | A * | 7/2007 |
| JP | 2008-225274 | A * | 9/2008 |
| WO | 2008/117878 | | 10/2008 |

OTHER PUBLICATIONS

Office Action in Korean Patent Application No. 10-2010-0106800, mailed Jan. 10, 2013.

* cited by examiner

DEVELOPING DEVICE, DEVELOPING CARTRIDGE, PROCESS CARTRIDGE AND IMAGE FORMING APPARATUS

FIELD OF THE INVENTION AND RELATED ART

The present invention relates to a developing device, a developing cartridge and a process cartridge which are detachably mountable to an electrophotographic image forming apparatus, and the image forming apparatus.

The developing device develops an electrostatic latent image formed on an image bearing member by a developing means to visualize the electrostatic latent image as a toner image.

The developing cartridge includes at least a developer carrying member (hereinafter referred to as a developing roller) and is detachably mountable to a main assembly of the image forming apparatus.

The process cartridge is prepared by integrally assembling the image bearing member and at least one of a charging means and the developing means into a cartridge, and the cartridge is detachably mountable to the main assembly of the image forming apparatus.

The image forming apparatus such as a printer or a facsimile machine includes the image bearing member and the developing device, and the electrostatic latent image formed on the image bearing member is developed by the developing device to be visualized as the toner image.

The developing device has conventionally included the developing roller disposed at an opening of a developing container and a developer supplying roller, disposed inside the developing container, for supplying a developer to the developing roller in some cases. Further, at one edge portion of the opening with respect to a longitudinal direction of the opening, a developing blade extending toward the developing roller is attached. Further, at the other edge portion of the opening with respect to the longitudinal direction of the opening, a sheet member extending toward the developing roller is attached in order to prevent the developer in the developing container from leaking out of the opening of the developing container and a gap between the developing roller and the other edge portion of the developing container.

In such a developing device, air flow occurs inside the developing container by rotation of the developing roller, so that a phenomenon that the inside of the developing container is in a higher air pressure state than an outside of the developing container can occur. For that reason, there is a possibility that the air and the toner inside the developing container leak out from the opening to contaminate the inside of the image forming apparatus main assembly and a recording material. As the invention for preventing the leakage of the air and the toner inside the developing container, Japanese Laid-Open Patent Application (JP-A) 2005-352076 discloses a developing device.

The developing device disclosed in JP-A 2005-352076 includes a developing container, a depressurizing hole provided in a wall of the developing container, a ventilating duct, and a duct collecting filter provided inside the ventilating duct. According to such a constitution, a high air pressure state inside the developing container is alleviated, so that a phenomenon that the inside of the image forming apparatus main assembly is contaminated with the toner and the recording material is contaminated with the toner is suppressed. This is also true for the developing cartridge, the process cartridge, and the image forming apparatus which have the same constitution.

In the developing device, the developing cartridge, the process cartridge, and the image forming apparatus which are described in JP-A 2005-352076, in order to prevent the toner from leaking out from the opening of the developing container due to impact (shock) during transportation, a toner seal member has been conventionally provided on the developing container in some cases. When the toner seal member is in a state in which it is removed, the phenomenon that the toner leaks out from the opening of the developing container is prevented.

However, in a state after the toner seal member is removed, during transportation or user handling, impact is exerted on the developing device, the developing cartridge, the process cartridge, or the image forming apparatus due to drop or the like in some cases. By such impact, the air inside the developing container is moved abruptly and the developing roller or a developer supplying roller is bent, so that the toner inside the developing container can leak out from the opening of developing container.

Particularly, a space enclosed by the developing container, the developing roller, the developer supplying roller and the sheet member is small (narrow) and therefore a pressure fluctuation due to the bending of the developing roller and the developer supplying roller is large. As a result, there is a possibility that the toner leaks out from a gap between the sheet member and the developing roller.

SUMMARY OF THE INVENTION

In view of the above-described circumstances, a principal object of the present invention is to provide a developing device, a developing cartridge, a developing container, and an image forming apparatus which are capable of lowering a possibility that toner leaks out from a gap between a sheet member and a developing roller.

According to an aspect of the present invention, there is provided a developing device comprising:

a developing container capable of accommodating a developer;

a developing roller, disposed at an opening of the developing container, for developing an electrostatic latent image formed on an image bearing member with the developer carried thereon;

a developer supplying roller, disposed inside the developing container, for supplying the developer to the developing roller in contact with the developing roller;

a sheet member, which is attached to the developing container at its base end portion and which contacts the developing roller at its free end portion, for preventing the developer from leaking out of the developer container;

a communication hole, provided in a wall of the developing container, for establishing communication between an inside and an outside of the developing container; and a filter member for covering the communication hole so as to prevent passage of the developer therethrough while permitting passage of air therethrough, wherein the communication hole is provided so as to be connected to an enclosed space defined by an inner wall of the developing container defining a smaller one of spaces provided by dividing the developing container by a plane including a rotation axis of the developer supplying roller and a rotational axis of the developing roller, a phantom plane which is included in the plane and extends from a surface of the developer supplying roller to the inner wall of the developer container, the sheet member, a surface of the developing roller, and a surface of the developer supplying roller.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7(*c*) is a schematic view showing an arrangement, relationship between the developing roller and a toner supply roller in a state in which the yellow developing cartridge is dropped on a floor, as seen from a Z direction indicated in FIG. 4, and FIG. 7(*d*) is a sectional view of the yellow developing cartridge taken along N-N line indicated in FIG. 7(*c*).

DESCRIPTION OF THE PREFERRED EMBODIMENTS

Embodiments of the present invention will be described more specifically with reference to the drawings. Dimensions, materials, configurations, relative positions, and so on of constituent parts which will be described hereinafter may be appropriately changed depending on the structures and various conditions of an image forming apparatus to which the present invention is applied, and the present invention is not limited thereto unless otherwise specified particularly.

Embodiment 1

Figure 1A:
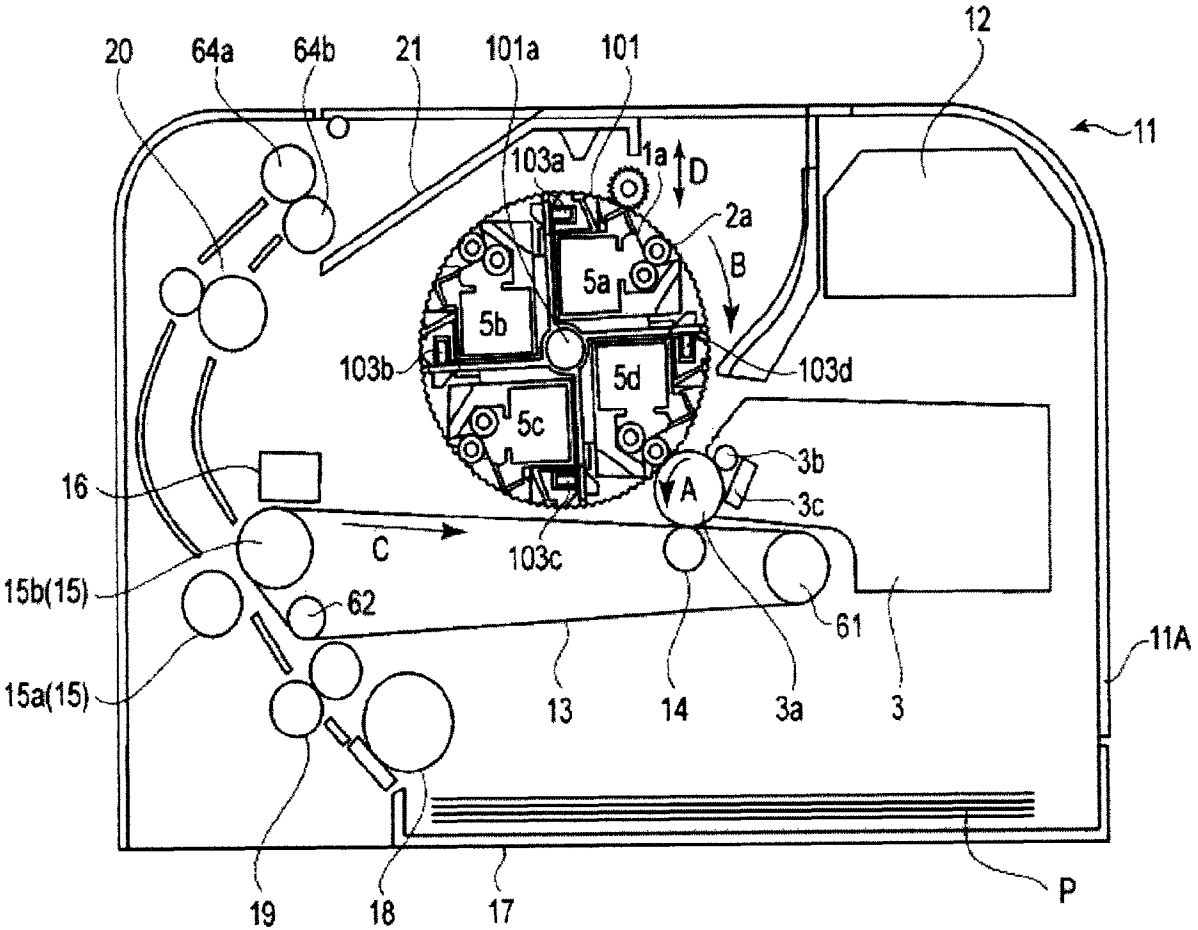
FIGS. 1A and 1B are sectional views showing a structure of an image forming apparatus including a developing cartridge according to Embodiment 1 of the present invention.

FIG. 1A is a sectional view showing a structure of an image forming apparatus 11 according to Embodiment 1 of the present invention. The image forming apparatus 11 utilizes an electrophotographic image forming process and is a four color-based full-color laser beam printer. As shown in FIG. 1A, the image forming apparatus 11 includes a main assembly 11A thereof and inside the main assembly 11A, an image forming portion for forming an image is provided. The image forming portion includes a photosensitive drum 3*a* as an image bearing member and includes a primary transfer roller 14 and the like.

The image forming apparatus 11 includes the photosensitive drum 3*a*. At a periphery of the photosensitive drum 3*a*, a charging roller 3*b* as a charging means for uniformly charging the photosensitive drum 3*a* and an exposure device 12 as an exposure means for irradiating the photosensitive drum 3*a* with laser light to form a latent image on the photosensitive drum 3*a* are disposed. Further, at the periphery of the photosensitive drum 3*a*, an one of developing cartridges, for developing the latent image formed on the photosensitive drum 3*a* with an associated color toner, consisting of yellow developing cartridge 5*a*, a magenta developing cartridge 5*b*, a cyan developing cartridge 5*c* and a black developing cartridge 5*d* is disposed. Further, at the periphery of the photosensitive drum 3*a*, a cleaning device 3*c* as a cleaning means for removing residual toner on the photosensitive drum 3*a* is disposed.

Herein, the photosensitive drum 3*a*, the charging roller 3*b* and the cleaning device 3*c* are integrally constituted and are assembled into a drum cartridge 3 which is detachably mountable to the image forming apparatus 11. The drum cartridge will be described. Each of the photosensitive drum 3*a*, the charging roller 3*b* and the cleaning device 3*c* may have an independent constitution or may also have an integral constitution. The yellow developing cartridge 5*a*, the magenta developing cartridge 5*b*, the cyan developing cartridge 5*c* and the black developing cartridge 5*d* are held by a rotary 101 which is rotatably attached to the apparatus main assembly 11A. Each of the yellow developing cartridge 5*a*, the magenta developing cartridge 5*b*, the cyan developing cartridge 5*c* and the black developing cartridge 5*d* may also be stationary type developing device fixed in the rotary 101. Incidentally, in this embodiment, a developing cartridge type in which the developing cartridge is detachably mountable to the rotary 101 like the yellow developing cartridge 5*a*, the magenta developing cartridge 5*b*, the cyan developing cartridge 5*c* and the black developing cartridge 5*d* is employed.

The rotary 101 has the same developing cartridge holding constitution with respect to all the yellow developing cartridge 5*a*, the magenta developing cartridge 5*b*, the cyan developing cartridge 5*c* and the black developing cartridge 5*d*. Therefore, in this embodiment, the constitution in which the rotary 101 holds each of the developing cartridges 5*a* to 5*d* will be described with respect to the yellow developing cartridge 5*a*.

An image forming operation will be described. First, the photosensitive drum 3*a* is rotated in a direction indicated by an arrow A in FIG. 1A. In synchronism with the rotation of the photosensitive drum 3*a*, an intermediary transfer belt 13 is rotated in a direction indicated by an arrow C in FIG. 1A. Then, the surface of the photosensitive drum 3*a* is uniformly charged by the charging roller 3*b* and is irradiated with light for a yellow image by the exposure means 12 as the exposure device, so that an electrostatic latent image for yellow is formed on the photosensitive drum 3*a*.

Figure 1B:
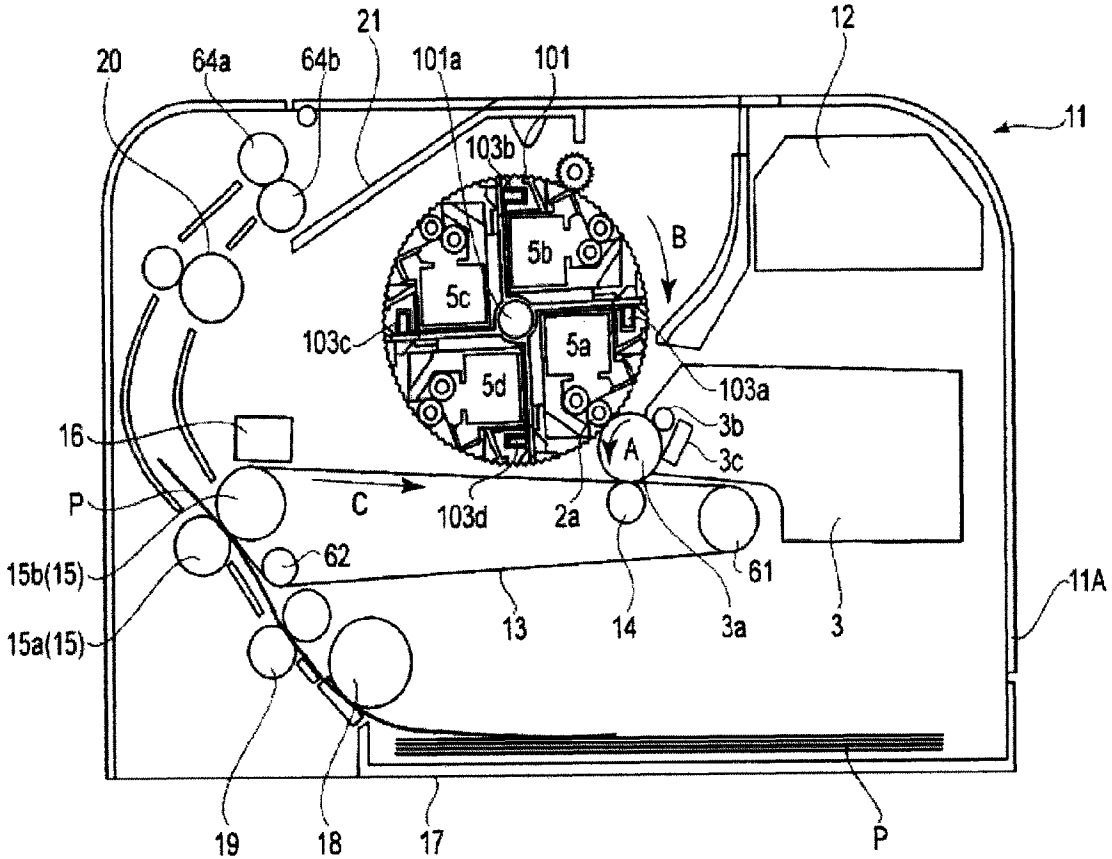

FIG. 1B is a sectional view showing a driving process of the image forming apparatus 11. As described above, the rotary 101 is rotatable while holding the yellow developing cartridge 5*a*, the magenta developing cartridge 5*b*, the cyan developing cartridge 5*c* and the black developing cartridge 5*d* simultaneously with the formation of the electrostatic latent image described above. The rotary 101 is rotated about a rotary rotation shaft (rotational axis) 101*a* in a direction indicated by an arrow B in FIG. 1A by a drive transmission mechanism provided in the apparatus main assembly 11A. By the rotation of the rotary 101, the yellow developing cartridge 5*a* is disposed at a developing position in which the yellow developing cartridge 5*a* opposes the photosensitive drum 3*a* as shown in FIG. 1B.

Then, a potential difference is set between the photosensitive drum 3*a* and the developing roller 2*a* so that a yellow developer is deposited on the latent image formed on the photosensitive drum 3*a*. As a result, the latent image formed on the photosensitive drum 3*a* is developed by depositing the yellow developer thereon. That is, a yellow developer image is formed on the photosensitive drum 3*a*.

Thereafter, by applying a voltage of an opposite polarity to the toner charge polarity to the primary transfer roller 14 disposed inside the intermediary transfer belt 13, the yellow toner image is primary-transferred from the photosensitive drum 3*a* on to the intermediary transfer belt.

When the above-described primary transfer of the yellow toner image is completed, the rotary 101 is further rotationally moved in the arrow B direction in FIG. 1B by receiving a driving force from the drive transmission mechanism of the image forming apparatus 11. Then, the magenta developing cartridge 5*b*, the cyan developing cartridge 5*c* and the black developing cartridge 5*d* are successively positioned at the developing position in which the positioned developing cartridge opposes the photosensitive drum 3*a*.

Similarly as in the case of yellow, with respect to each of the colors of magenta, cyan and black, the formation of the electrostatic latent image, the development of the electrostatic latent image and the primary transfer are successively performed, so that four color toner images are superposed on the intermediary transfer belt 13.

Inside the intermediary transfer member 13, the primary transfer roller 14 described above, and an inner secondary transfer roller 15*b* and rollers 61 and 62 which are a conveying means for conveying a sheet as a recording material (medium) are disposed. During the superposition of the toner images, a secondary transfer roller 15 as the conveying means is disposed in non-contact with the intermediary transfer belt 13. Further, a cleaning unit 16 for the intermediary transfer belt 13 is also disposed in non-contact with the intermediary transfer belt 13.

On the other hand, sheets P which are a member on which the toner images are to be transferred are stacked and accommodated in a sheet feeding cassette 17 provided at a lower portion of the apparatus main assembly 11A. The sheets P are separated and fed one by one from the sheet feeding cassette 17 by a sheet feeding roller 18 as a feeding means, thus being fed to conveying rollers 19 as the conveying means. The conveying rollers 19 send the fed sheets P between the intermediary transfer belt 13 and the secondary transfer roller 15*a*. Here, as shown in FIG. 1B, the secondary transfer roller 15 is in a state in which it press-contacts the intermediary transfer belt 13.

Further, the voltage of the opposite polarity to the toner charge polarity has been applied to the secondary transfer roller 15*a*, so that the above-described four color toner images superposed on the intermediary transfer belt 13 are secondary-transferred onto the surface of the conveyed sheet P.

The sheet P on which the toner images are transferred is sent to a fixing device 20. In the fixing device 20, the sheet P is heated and pressed, so that the toner images are fixed on the sheet P. As a result, an image is formed on the sheet P. Thereafter, the sheet P is discharged from the fixing device 20 to a sheet discharge portion 21 outside the image forming apparatus 11 through (sheet) discharging rollers 64*a* and 64*b* as a discharging means.

Figure 2:
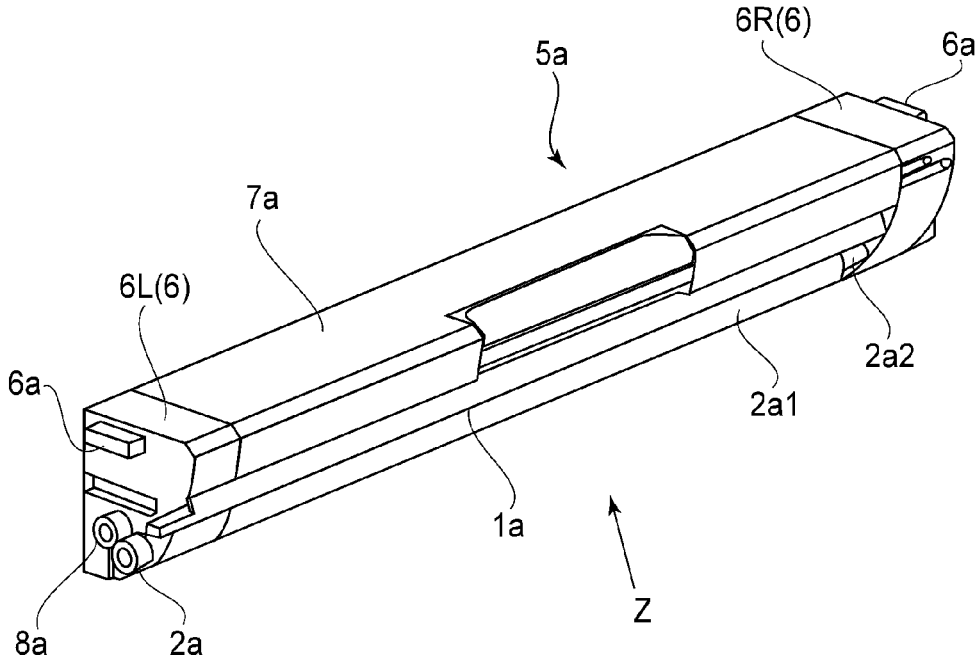
FIG. 2 is a perspective view showing a structure of a yellow developing cartridge.

FIG. 2 is a perspective view showing a structure (constitution) of the yellow developing cartridge 5*a*. Hereinafter, the structure of the yellow developing cartridge 5*a* will be described but those of the magenta developing cartridge 5*b*, the cyan developing cartridge 5*c* and the black developing cartridge 5*d* are similar to the structure of the yellow developing cartridge 5*a*. As shown in FIG. 2, the yellow developing cartridge 5*a* includes a developing container 7*a* capable of accommodating the developer. Inside the developing container 7*a*, a developing roller 2*a* and a toner supply roller 8*a* which extend in a longitudinal direction of the developing container 7*a*. At end portions of the developing container 7*a* with respect to the longitudinal direction, side members 6L and 6R are attached.

Further, on each of these two side members 6 (i.e., the side members 6L and 6R), a portion to be locked 6*a* engageable with a locking member 103*a* of the rotary 101 is formed. For this reason, detaching of the yellow developing cartridge 5*a* from the rotary 101 is suppressed. Incidentally, the locking member 103*a* (FIG. 1A) engages with the yellow developing cartridge 5*a* by a spring (not shown), thus preventing movement of the yellow developing cartridge 5*a* in a direction indicated by a double-pointed arrow D indicated in FIG. 1A. Further, on each of the magenta developing cartridge 5*b*, the cyan developing cartridge 5*c* and the black developing cartridge 5*d*, a portion to be locked similar to the portion to be locked 6*a* is provided. These portions to be locked are engaged with locking members 103*b*, 103*c* and 103*d*, respectively, provided in the rotary 101 in order to lock the developing cartridges 5 (5*a*, 5*c* and 5*d*), thus suppressing the detaching of the developing cartridges 5 from the rotary 101.

Figure 3:
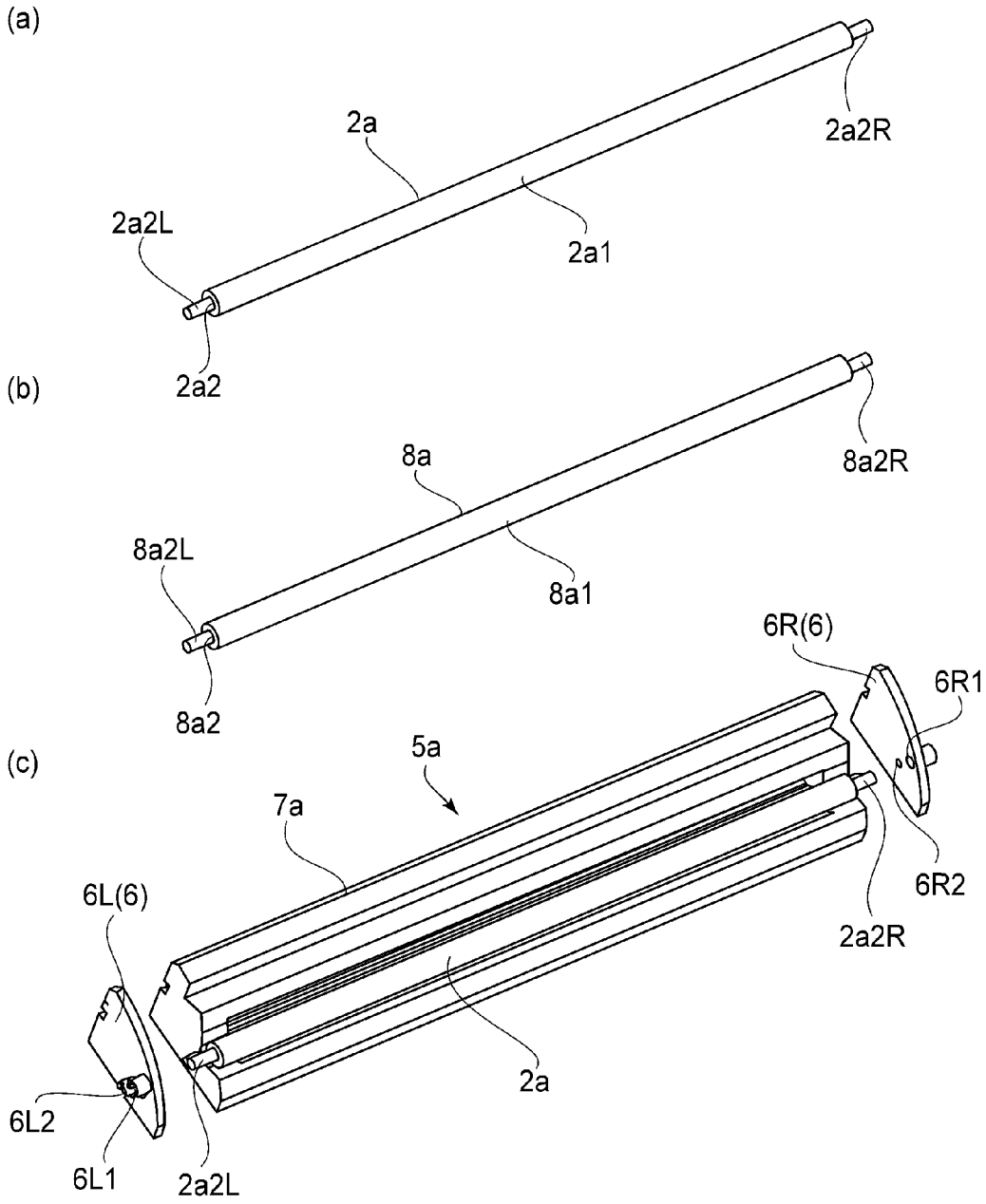
FIGS. 3(*a*), 3(*b*) and 3(*c*) are perspective views showing structures of a developing roller, a toner supply roller and the yellow developing cartridge, respectively.

FIG. 3(*a*) is a perspective view showing a structure of the developing roller 2*a*. As shown in FIG. 3(*a*), the developing roller 2*a* includes a rigid shaft 2*a*2 and a rubber roller portion 2*a*1 formed around the rigid shaft 2*a*2. That is, the rigid shaft 2*a*2 penetrates the rubber roller portion 2*a*1 in a direction along the rotational axis of the developing roller 2*a*, so that end portions of the rigid shaft 2*a*2 are projected from the rubber roller portion 2*a*1 to constitute projected portions 2*a*2L and 2*a*2R.

FIG. 3(*b*) is a perspective view showing a structure of the toner supply roller 8*a*. As shown in FIG. 3(*b*), the toner supply roller 8*a* includes a rigid shaft 8*a*2 and a sponge roller portion 8*a*1 formed around the rigid shaft 8*a*2. That is, the rigid shaft 8*a*2 penetrates the sponge roller portion 8*a*1 in a direction along the rotational axis of the toner supply roller 8*a*, so that end portions of the rigid shaft 8*a*2 are projected from the sponge roller portion 8*a*1 to constitute projected portions 8*a*2L and 8*a*2R.

FIG. 3(*c*) is an exploded perspective view showing an inner structure (constitution) of the developing container 7*a* from which the side members 6L and 6R are detached. As shown in FIG. 3(*c*), the side member 6L is provided with holes 6L1 and 6L2, and the side member 6R is provided with holes 6R1 and 6R2. Into the hole 6L1, the projected portion 2*a*2L of the developing roller 2*a* is inserted and into the hole 6R1, the projected portion 2*a*2R of the developing roller 2*a* is inserted, so that the developing roller 2*a* is rotatable relative to the developing container 7*a*. Into the hole 6L2, the projected portion 8*a*2L of the toner supply roller 8*a* is inserted and into the hole 6R2, the projected portion 8*a*2R of the toner supply roller 8*a* is inserted, so that the toner supply roller 8*a* is rotatable relative to the developing container 7*a*. Thus, the yellow developing cartridge 5*a* rotatably holds the developing roller 2*a* and the toner supply roller 8*a* by the side members 6L and 6R for holding the projected portions 2*a*2L and 2*a*2R, respectively, of the developing roller 2*a*.

Figure 4:
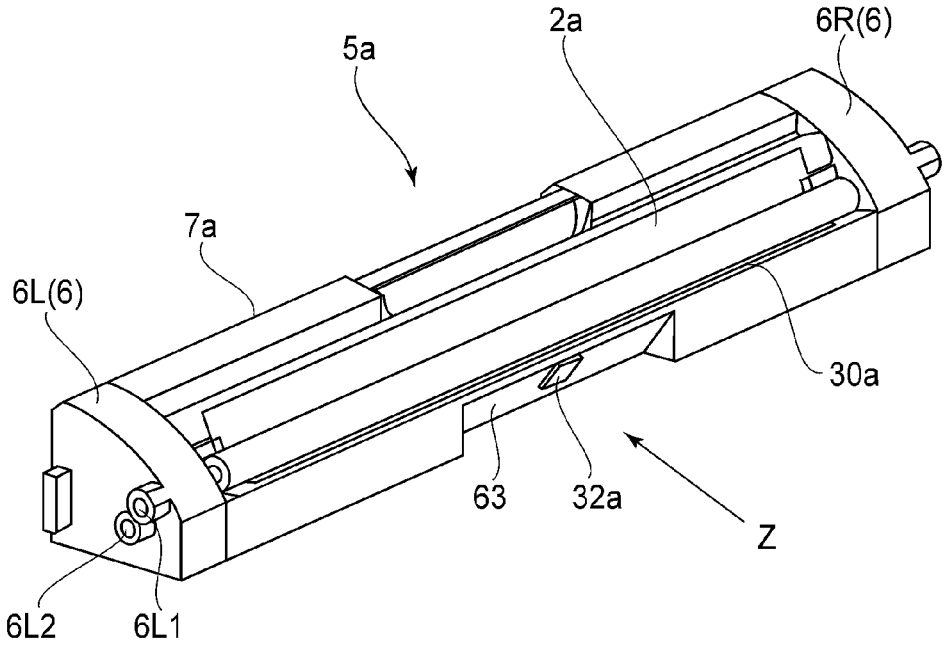
FIG. 4 is a perspective view showing the structure of the yellow developing cartridge.

FIG. 4 is a perspective view showing the structure of the yellow developing cartridge 5*a*. As shown in FIG. 4, a recessed portion 63 is formed at a central portion of the developing container 7*a* with respect to the longitudinal direction of the developing container 7*a*. The recessed portion 63 is provided with a communication hole 31*a* (FIG. 5) for establishing communication between the inside and the outside of the developing container 7*a*. On the communication hole 31*a*, a filter member 32*a* is fixed so as to cover the communication hole 31*a* from the outside of the developing container 7*a*. Therefore, the communication hole 31*a* and the filter member 32*a* are provided at the central portion of the developing container 7*a* with respect to an axial direction of the developing roller 2*a*. Incidentally, the communication hole 31*a* and the filter member 32*a* may only be required to be provided in the neighborhood of the central portion of the developing container 7*a* with respect to the longitudinal direction of the rubber roller portion 2*a*1. Fixation of the filter member 32*a* on the developing container 7*a* is performed by bonding the filter member 32*a* to the developing container 7*a* through welding but my fixing method can be employed.

Further, the developing roller 2*a* as a developer carrying member is disposed at an opening 52 (FIG. 5) of the developing container 7*a* and develops the electrostatic latent image, formed on the photosensitive drum 3*a* as the image bearing member, with the developer. The toner supply roller 8*a* as a developer supplying roller is disposed inside the developing container 7*a* and the supplies the developer to the developing roller 2*a* in contact with the developing roller 2*a*.

Figure 5:
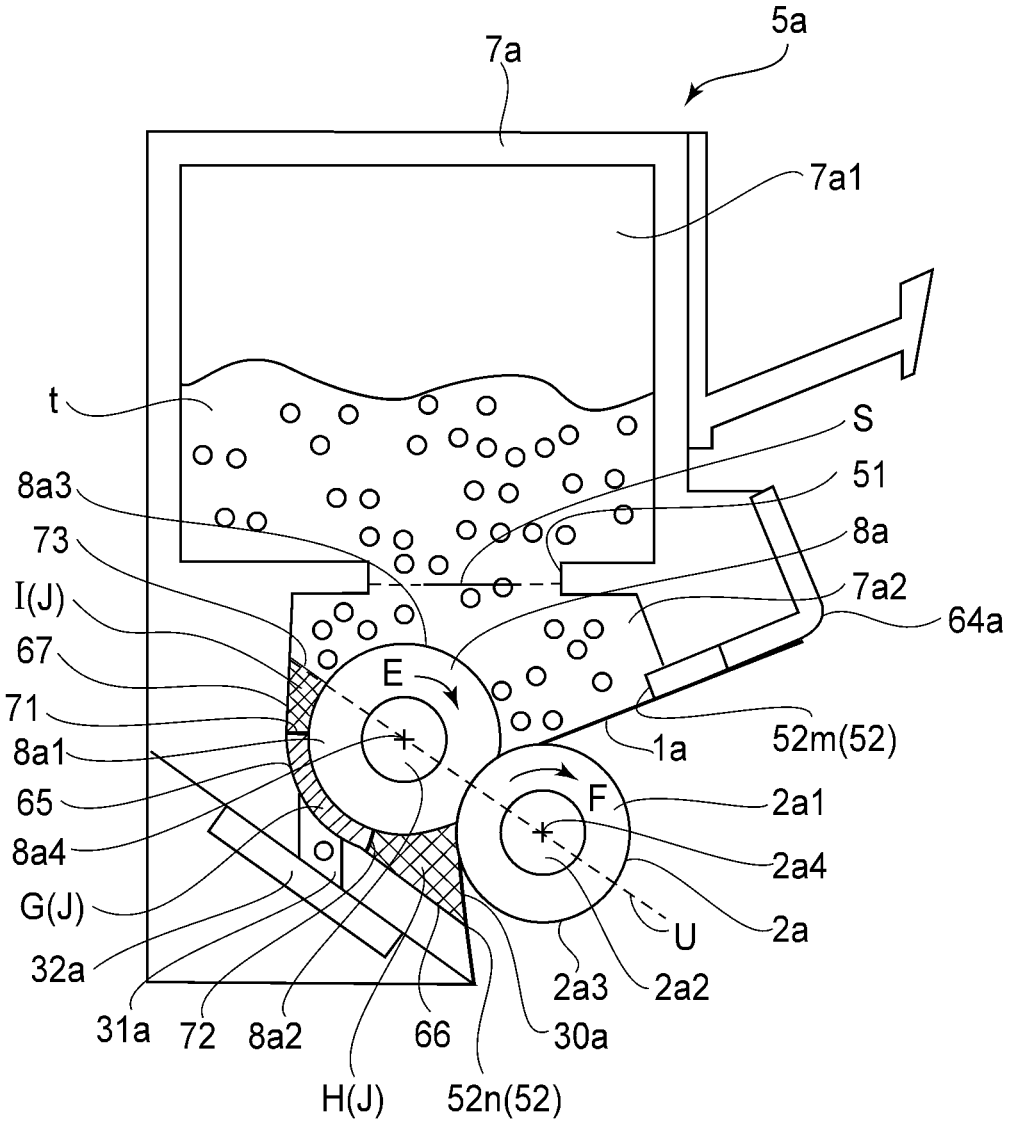
FIG. 5 is a sectional view showing the structure of the yellow developing cartridge.

FIG. 5 is a sectional view showing the structure of the yellow developing cartridge 5*a*. As shown in FIG. 5, the developing container 7*a* of the yellow developing cartridge 5*a* includes a first chamber 7*a*1 and a second chamber 7*a*2. Between the first chamber 7*a*1 and the second chamber 7*a*2, a through-opening 51 is provided, so that toner t inside the first chamber 7*a*1 can move to the second chamber 7*a*2. The through-opening 51 is sealed with a toner seal member S before the yellow developing cartridge 5*a* is used, so that the movement of the toner t from the first chamber 7*a*1 to the second chamber 7*a*2 is suppressed. The opening is uncovered by removing the seal member S by a user or the like at the time of starting the use of the cartridge, so that the toner inside the first chamber 7*a*1 is supplied into the second chamber 7*a*2. The second chamber 7*a*2 is provided with the opening 52. The opening 52 is defined by a portion including an upper edge portion 52*m* and a lower edge portion 52*n*.

On the upper edge portion 52*m* side of the opening 52, a developing blade 1*a* extending toward the surface of the developing roller 2*a* is attached. That is, the developing blade 1*a* is attached to the developing container 7*a* at its base end portion and contacts the developing roller 2*a* at its free end portion, thus regulating a layer thickness of the developer on the surface of the developing roller 2*a*.

On the other hand, on the lower edge portion 52*n* side of the opening 52, an elastic sheet member 30*a* extending toward the surface of the developing roller 2*a* is attached. That is, the elastic sheet member 30*a* is attached to the developing container 7*a* at its base end portion and contacts the developing roller 2*a* at its free end portion, thus preventing the developer from leaking out of the developing container 7*a*.

In the second chamber 7*a*2 and inside and the opening 52, the toner supply roller 8*a* is disposed. At the opening 52, the developing roller 2*a* is disposed.

In the developing container 7*a*, the toner t is fed. The toner t in the first chamber 7*a*1 moves to the second chamber 7*a*2. The toner t is fed (supplied) to the toner supply roller 8*a*, and when the toner supplying roller 8*a* rotated about a rotational axis 8*a*4 in a direction indicated by an arrow E, the toner t is fed to the developing roller 2*a*.

When the developing roller 2*a* is rotated about a rotational axis 2*a*4 in a direction indicated by an arrow F, the toner t on the developing roller 2*a* is subjected to the development (of the electrostatic latent image formed) on the photosensitive drum 3*a* while being regulated by the developing blade 1*a*. The toner t left on the developing roller 2*a* after the development is removed by the toner supplying roller 8*a*. Thereafter, the toner t is fed again to the developing roller 2*a* by the toner supplying roller 8*a*. To the developing roller 2*a*, a voltage is applied from the image forming apparatus 11 in order to provide a potential difference between the developing roller 2*a* and the photosensitive drum 3*a*. Also to the toner supply roller 8*a*, a voltage is applied from the image forming apparatus 11.

The elastic sheet member 30*a* functions as the toner seal member for preventing the toner t inside the second chamber 7*a*2 from leaking out from between the lower edge portion 52*n* of the opening 52 and the rubber roller portion 2*a*1 of the developing roller 2*a*. The base end of the elastic sheet member 30*a* is fixed on the developing container 7*a* along the longitudinal direction. Further, the free end of the elastic sheet member 30*a* contacts the entire developing area of the rubber roller portion 2*a*1 along the longitudinal direction. The elastic sheet member 30*a* contacts the developing roller 2*a* with a small pressure. This is because when the contact pressure of the elastic sheet member 30*a* with respect to the developing roller 2*a* is large, the toner layer on the developing roller 2*a* is disturbed and thus there is a possibility of an occurrence of image defect.

Further, at a developing position, in order to stably bring the developing roller 2*a* into contact with the photosensitive drum 3*a*, the yellow developing cartridge 5*a* is urged toward the photosensitive drum 3*a* together with the rotary 103 which holds the yellow developing cartridge 5*a*. As a result, the developing roller 2*a* of the yellow developing cartridge 5*a* can contact the photosensitive drum 3*a* with a predetermined pressure.

The developing container 7*a* is provided with the communication hole 31*a* in a wall of the second chamber 7*a*2 so as to establish communication between the inside and the outside of the developing container 7*a*. The filter member 32*a* is attached to the developing container 7*a* so as to externally cover the communication hole 31*a*. The filter member 32*a* covers the communication hole 31*a*, thus preventing passage of the developer while permitting passage of the air.

Here, the surface of the sponge roller portion 8*a*1 of the toner supply roller 8*a* constitutes a roller surface 8*a*3, and an inner wall surface of the developing container 7*a* which is formed coaxially with a rotation center 8*a*4 of the toner supply roller 8*a* along the (circumferential) roller surface 8*a*3 of the toner supply roller 8*a* constitutes a coaxial surface (curved surface portion) 65. Further, a phantom plane which can be drawn from a lowermost-stream position of the coaxial surface (curved surface portion) 65, with respect to the toner supply roller rotational direction, to the roller surface 8*a*3 constitutes a first phantom plane 71. Further, a phantom plane which can be drawn from an uppermost-stream position of the coaxial surface 65, with respect to the toner supply roller rotation direction, to the roller surface 8*a*3 constitutes a second phantom plane 72. Further, a space enclosed by the toner supply roller surface 8*a*3, the coaxial surface 65, the first phantom plane 71 are the second phantom plane 72 constitutes a phantom space G. Incidentally, the first phantom plane 71, the second phantom plane 72 and the phantom space G are not present actually but are the planes and the space which are used for showing the position or the area inside the developing container 7*a* for convenience's sake. This is true for an enclosed space J, a third phantom plane 73, a phantom plane H, and a phantom plane I described later.

Further, the surface of the rubber roller portion 2*a*1 of the developing roller 2*a* constitutes a roller surface 2*a*3, and the surface of the developing container 7*a* formed closer to the elastic sheet member 30*a* than the phantom space G constitutes an inner wall surface 66. A distance between the inner wall surface 66 and the roller surface 8*a*3 is larger than a distance between the curved surface portion 65 and the roller surface 8*a*3. A space enclosed by the roller surfaces 2*a*3 and 8*a*3, the phantom plane 72, the inner wall surface 66 and the elastic sheet member 30*a* constitutes the phantom space H.

Further, the surface of the developing container 7*a* formed farther from the elastic sheet member 30*a* than the phantom space G constitutes an inner wall surface 67. A distance between the inner wall surface 67 and the roller surface 8*a*3 is larger than a distance between the curved surface portion 65 and the roller surface 8*a*3. Further, a plane including a rotational axis 8*a*4 of the toner supply roller 8*a* and a rotational axis 2*a*4 of the developing roller 2 constitutes a plane U. A phantom plane which is provided in this plane U so as to extend from the roller surface 8*a*3 of the toner supply roller 8*a* to the inner wall of the developing container 7*a* constitutes the third phantom plane 73. Further, a space enclosed by the roller surface 8*a*3, the first phantom plane 71, the inner wall surface 67 and the third phantom plane 73 constitutes the phantom space I. Further, a space enclosed by the toner supply roller surface 8*a*3, the second phantom plane 72, the inner wall surface 66, the elastic sheet member 30*a* and the developing roller surface 2*a*3 constitutes the phantom space H.

The communication hole 31*a* described above establishes communication between an area including the phantom spaces G, H and I, and an external area of the developing container 7*a*. The communication hole 31*a* faces the enclosed space J including the phantom spaces G, H and I and opens to the inside of the developing container 7*a*. That is, the communication hole 31*a* is provided so as to be connected to the enclosed space J. For that reason, the air in the enclosed space J can pass through the communication hole 31*a*. Further, the air can move to the outside of the developing container 7*a*.

That is, particularly, the enclosed space J enclosed (defined) by the developing container 7*a*, the developing roller 2*a*, the toner supply roller 8*a* and the elastic sheet member 30*a* is narrow, so that a change in pressure occurs due to bending of the developing roller 2*a* and the toner supply roller 8*a*. Particularly, the pressure change is large in the neighborhood of longitudinal central portion at which the developing roller 2*a* and the toner supply roller 8*a* are liable to be bent largely, so that there is a possibility of an occurrence of the leakage of the toner from between the developing roller 2*a* and the elastic sheet member 30*a* contacting the developing roller 2*a* with the small pressure.

In the present invention, by employing such a constitution that the communication hole 31*a* is directly connected to a small space when the developing container 7*a* is divided into the small space and a large space by the plane U described above, the toner leakage is effectively suppressed. When the developing container 7*a* is divided into the small space and the large space, the small space is the enclosed space J, and the large space is a space in the developing container 7*a* except the enclosed space J (the space located above the plane U in FIG. 5). Therefore, the inner wall of the developing container 7*a* constituting the enclosed space J is the inner wall constituting the small space when the developing container 7*a* is divided into the small space and the large space. In FIG. 5, this inner wall corresponds to the inner wall surfaces 66, 65 and 67.

In this embodiment, the communication hole 31*a* is connected to the phantom space G which is a narrowest area of the small space (the enclosed space). That is, the communication hole 31*a* is configured to be connected to the curved surface portion 65 of the container inner wall. As a result, a pressure fluctuation in the narrow (small) space in which the pressure change is most liable to occur can be quickly attenuated, so that the toner leakage can be suppressed effectively.

As the toner t, toner particles having an average particle size of 6-8 μm are used. On the other hand, as the filter member 32, a member having a hole diameter of 5 μm is used in a superposed state. For this reason, the filter member 32 prevents the leakage of the toner t while permitting the passage of the air. Thus, the hole diameter of the filter member 32 may preferably be smaller than the toner particle size. However, in the case where the filter member 32 is used in the superposed state, even when the hole diameter of the filter member 32 is larger than the toner particle size, the toner leakage from the filter member 32 can be prevented. According to an experiment, it was possible to prevent the toner leakage from the filter member 32 with respect to the filter members 32 having the hole diameters up to 80 μm. As the filter member 32 used in this embodiment, it is possible to use a filter member as described in, e.g., JP-A (Tokkai) Hei 11-338234.

Figure 6:
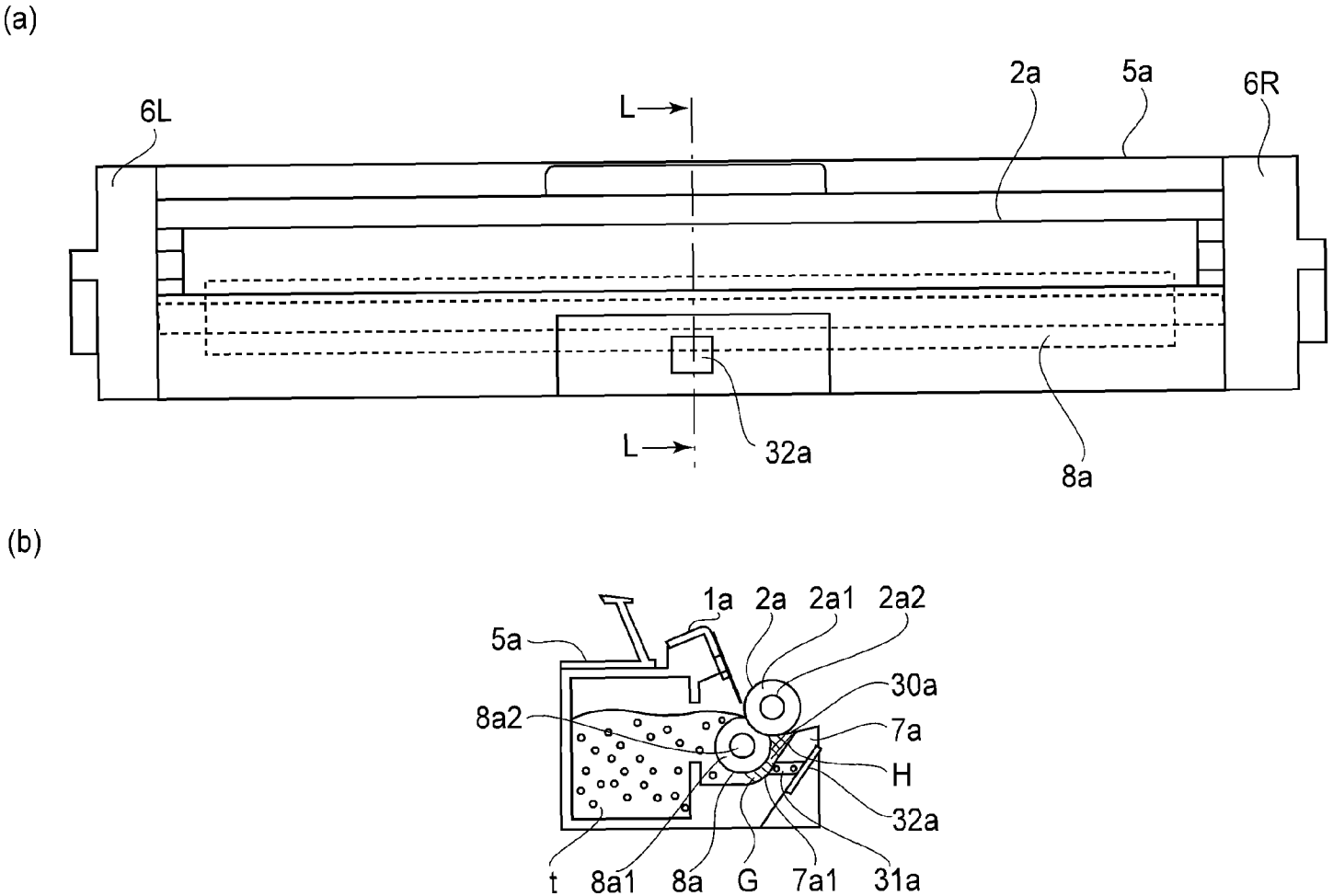
FIG. 6(*a*) is a schematic view showing an arrangement, relationship between the developing roller and a toner supply roller in a normal state as seen from a Z direction indicated in FIG. 4, and FIG. 6(*b*) is a sectional view of the yellow developing cartridge taken along L-L line indicated in FIG. 6(*a*).

FIG. 6(*a*) shows an arrangement relationship between the developing roller 2*a* and the toner supply roller 8*a* in a normal use state, as seen from a Z direction in FIG. 4. FIG. 6(*b*) is a sectional view taken along L-L line indicated in FIG. 6(*a*). As shown in FIG. 6(*a*), in the normal use state, the developing roller 2*a* and the toner supply roller 8*a* are in a state in which these rollers are extended in a straight line. The filter member 32*a* is located at the central portion of the developing container 7*a* corresponding to a substantially central portion of the sponge roller portion 8*a*1 of the toner supply roller 8*a* and is located at a portion corresponding to a lower end portion of the sponge roller portion 8*a*1. Further, as shown in FIG. 6(*b*), the volume of the narrow area is kept at that in the normal (use) state. Further, the developing roller 2*a* is in a state in which the developing roller 2*a* partly deforms the sponge roller portion 8*a*1 of the toner supply roller 8*a*.

Figure 7:
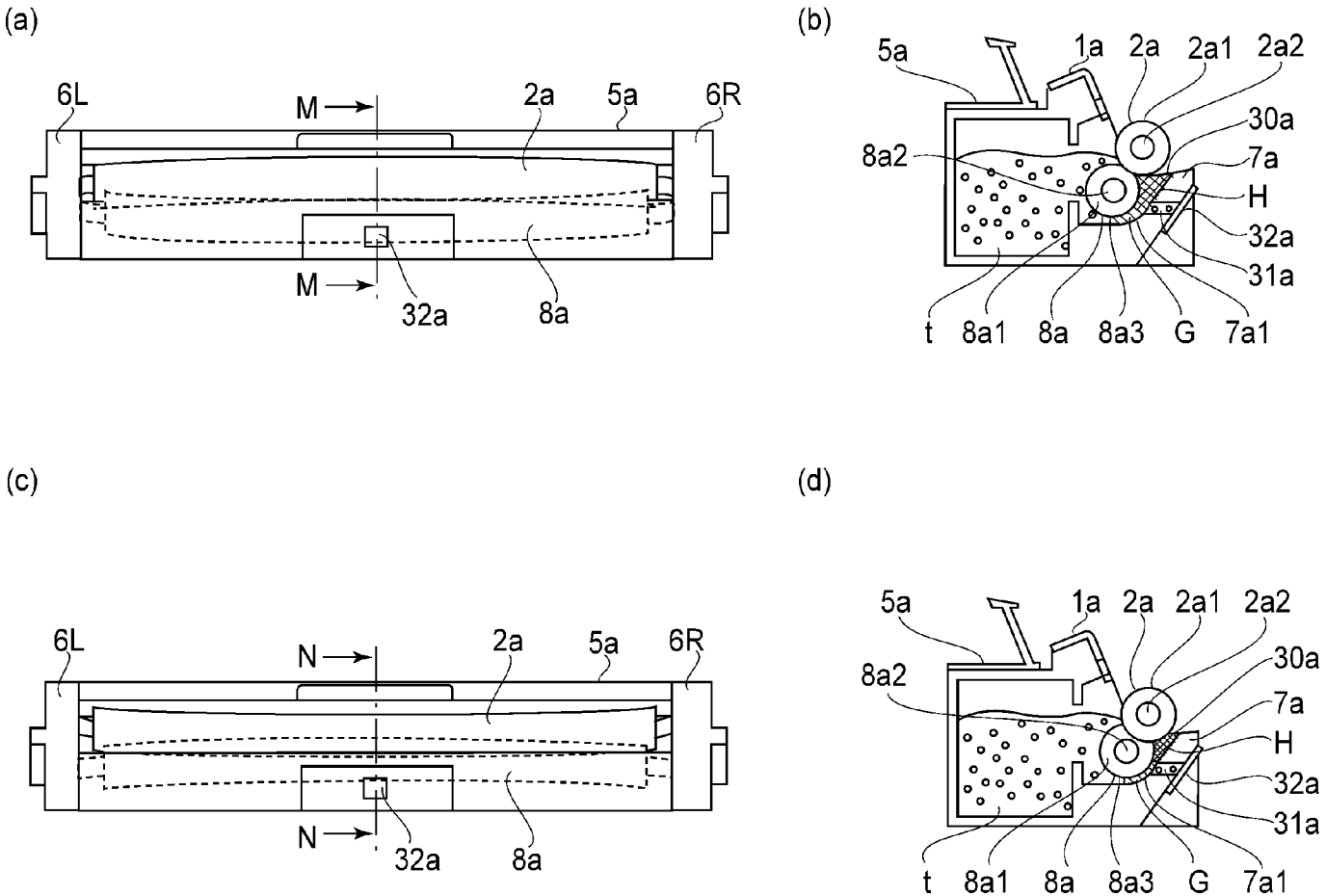
FIG. 7(*a*) is a schematic view showing an arrangement, relationship between the developing roller and a toner supply roller in a state in which the yellow developing cartridge is dropped on a floor, as seen from a Z direction indicated in FIG. 4, and FIG. 7(*b*) is a sectional view of the yellow developing cartridge taken along M-M line indicated in FIG. 7(*a*).

FIG. 7(*a*) shows an arrangement relationship between the developing roller 2*a* and the toner supply roller 8*a* in the case where the yellow developing cartridge 5*a* is dropped on a floor and is a sectional view, as seen from the Z direction in FIG. 4. FIG. 7(*b*) is a sectional view taken along M-M line indicated in FIG. 7(*a*). As shown in FIG. 7(*a*), in the case where the yellow developing cartridge 5*a* is subjected to impact due to transportation or dropping, the developing roller 2*a* and the toner supply roller 8*a* can be bent in a direction in which the central portions of the developing roller 2*a* and the toner supply roller 8*a* with respect to the longitudinal direction are spaced from each other. Further, in this case, as shown in FIG. 7(*b*), the central portions of the developing roller 2*a* and the toner supply roller 8*a* with respect to the longitudinal direction are spaced from each other, so that the volume of the narrow area, i.e., the phantom spaces G and H is enlarged compared with that in the normal state.

FIG. 7(*c*) shows an arrangement relationship between the developing roller 2*a* and the toner supply roller 8*a* in the case where the yellow developing cartridge 5*a* is dropped on a floor and is a sectional view, as seen from the Z direction in FIG. 4. FIG. 7(*d*) is a sectional view taken along N-N line indicated in FIG. 7(*c*). As shown in FIG. 7(*c*), in the case where the yellow developing cartridge 5*a* is subjected to impact due to transportation or dropping, the developing roller 2*a* and the toner supply roller 8*a* can be bent in a direction in which the central portions of the developing roller 2*a* and the toner supply roller 8*a* with respect to the longitudinal direction approach each other. Further, in this case, as shown in FIG. 7(*b*), the central portions of the developing roller 2*a* and the toner supply roller 8*a* with respect to the longitudinal direction approach each other, so that the volume of the narrow area, i.e., the phantom spaces G and H is reduced compared with that in the normal state.

Thus, when the state of the volume of the phantom spaces G and H is instantaneously changed to the state as shown in FIGS. 7(*a*) and 7(*b*) or the state as shown in FIGS. 7(*c*) and 7(*d*), internal pressure of the phantom spaces G and H is largely changed. Particularly, the developing roller 2*a* and the toner supply roller 8*a* are largely bent in the neighborhood of their longitudinal central portions with the side members 6L and 6R as a supporting point, compared with the neighborhood of their longitudinal end portions. As a result, inside the developing container 7*a*, the internal pressure in the neighborhood of the longitudinal central portion is changed largely compared with that in the neighborhood of the longitudinal end portions.

In this embodiment, the drum cartridge 3 at least including the photosensitive drum 3*a* and the charging roller 3*b* and the developing cartridge 5 at least including the developing roller 2*a* have independent constitutions, and each of the cartridges is detachably mountable to the apparatus main assembly 11A. However, the form of the cartridges is not limited to those described above but may also be that of a process cartridge having a constitution in which the drum cartridge 3 and the developing cartridge 5 are integrally assembled.

Here, the yellow developing cartridge 5*a* is prepared by integrally assembling the developing roller 2*a* for developing the electrostatic latent image formed on the photosensitive drum 3*a*, the developing container 7*a* for accommodating the developer, and the developing blade 1*a* into a cartridge, which is detachably mountable to the apparatus main assembly 11A. On the other hand, the process cartridge is prepared by integrally assembling the photosensitive drum 3*a*, the developing roller 2*a* for developing the electrostatic latent image formed on the photosensitive drum 3*a*, and the developing container 7*a* for accommodating the developer into a cartridge, which is detachably mountable to the apparatus main assembly 11A.

Also in the case of the process cartridge in which the drum cartridge 3 and the developing container 5 (5*a*-5*d*) are integrally assembled, when the developing container is dropped and impact-applied during the transportation or by user handling, the pressure change occurs in the neighborhood of the elastic sheet member 30*a*. When a degree of the toner leakage due to the pressure change is reduced, similarly as in this embodiment, the communication hole 31*a* is provided at a portion enclosed by the developing container 7*a*, the developing roller 2*a*, the toner supply roller 8*a* and the elastic sheet member 30*a* and the outside of the portion is covered with the filter member 32*a* by bonding. As a result, the pressure change in the neighborhood of the elastic sheet member 30*a* when the impact is exerted on the process cartridge can be reduced, so that it is possible to provide the process cartridge from which the toner is not leaked readily.

In the conventional constitution, in the case where the yellow developing cartridge 5*a* was subject to the drop impact during the transportation or during the user handling, the toner was leaked in some instances by abrupt movement of the air inside the developing container 7*a* or by bending of the developing roller 2*a* or the toner supply roller 8*a*. Particularly, the space enclosed by the developing container 7*a*, the developing roller 2*a*, the toner supply roller 8*a* and the elastic sheet member 30*a* is narrow, and the developing roller 2*a* and the toner supply roller 8*a* are bent to cause the change in pressure. Particularly, in the neighborhood of the longitudinal central portion at which the rollers are liable to be bent largely, the change in pressure is large. Therefore, there was a possibility of an occurrence of the toner leakage from between the developing roller 2*a* and the elastic sheet member 30*a* contacting the developing roller 2*a* with the small pressure. In such a situation, when the impact is exerted on the cartridge due to the transportation or the dropping, according to this embodiment, it is possible to provide the developing device, the developing cartridges 5*a* to 5*d*, the process cartridge and the image forming apparatus 11 which do not readily cause the toner leakage.

Further, in the neighborhood of the portion at which the toner t is liable to be leaked out due to the change in internal pressure of the developing container 7*a*, in order to reduce the pressure change, the filter member 32*a* which permits the passage of the air and prevents the passage of the toner t is provided.

Embodiment 2

Figure 8:
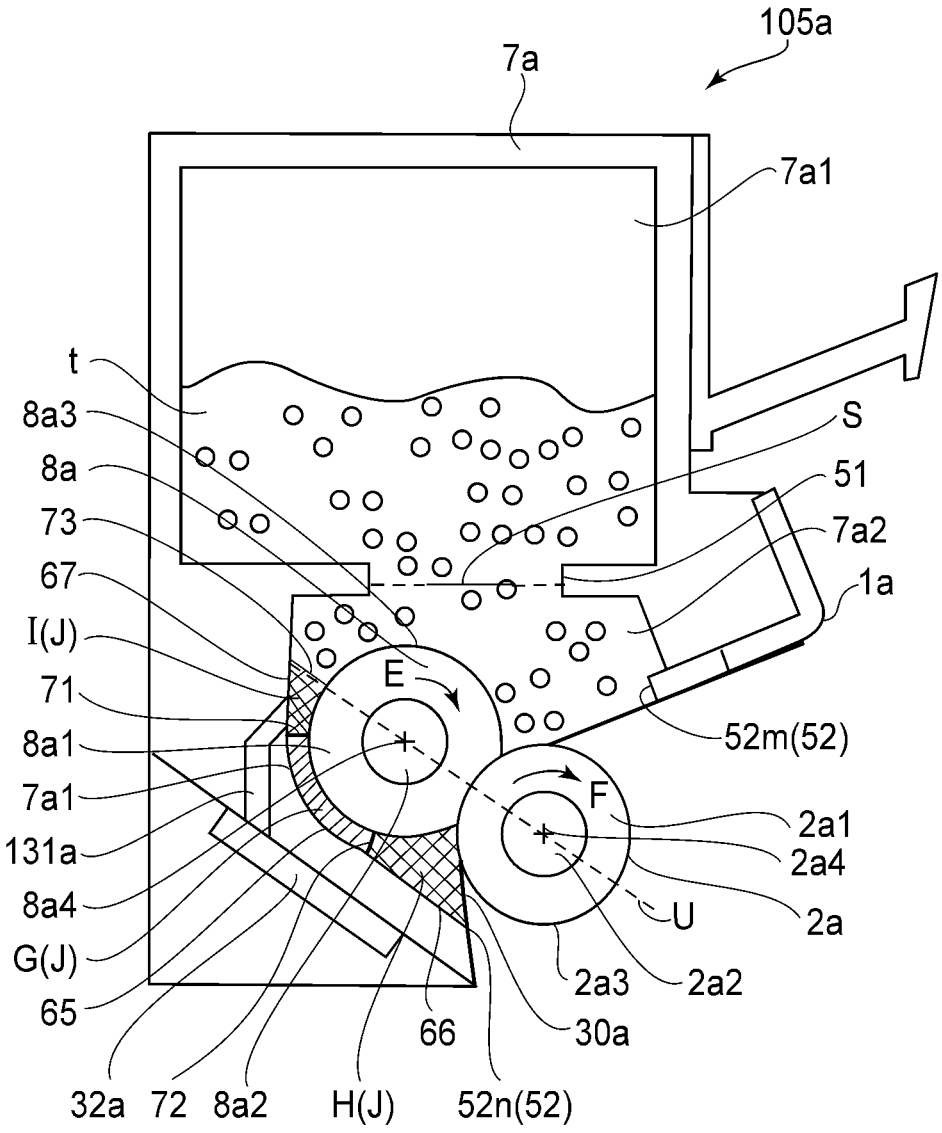
FIG. 8 is a sectional view showing a structure of developing cartridge according to Embodiment 2.

FIG. 8 is a sectional view showing a structure of a yellow developing cartridge 105*a* according to Embodiment 2. With respect to the yellow developing cartridge 105*a*, portions or members having the same constitutions and effects as those for the yellow developing cartridge 5*a* in Embodiment 1 are represented by the same reference numerals or symbols and will be appropriately omitted from description. Also in Embodiment 2, the yellow developing cartridge 105*a* is applicable to the image forming apparatus similar to that in Embodiment 1, so that the description of the image forming apparatus will be omitted. A difference of the yellow developing cartridge 105*a* in Embodiment 2 from the yellow developing cartridge 5*a* in Embodiment 1 is that a path of the creation of a communication hole 131*a* is different from that of the communication hole 31*a*. Incidentally, only the constitution of the yellow developing cartridge 105*a* will be described but the magenta developing cartridge, the cyan developing cartridge and the back developing cartridge have the same constitution.

That is, as shown in FIG. 8, the communication hole 131*a* is provided in the wall of the second chamber 7*a*2 inside the enclosed space J similarly as in Embodiment 1 but is provided at a position which is farther from the elastic sheet member 30*a* than the phantom space G, i.e., is open to the inside of the developing container 7*a* in the phantom space I. Also in this embodiment, the communication hole 131*a* is configured to be connected to the enclosed space J which is the narrow space in which the pressure change is liable to become large, so that the toner leakage can be suppressed.

According to the constitutions of Embodiments 1 and 2, in the case where the developing device, the developing cartridge, the process cartridge and the image forming apparatus are subjected to the impact, the pressure fluctuation due to the bending of the developing roller 2*a* and the toner supply roller 8*a* can be reduced efficiently. As a result, in the case where the toner seal member S is removed, it is possible to reduce the possibility of the leakage of the toner t from the gap between the elastic sheet member 30*a* and the developing roller 2*a*.

In the case where the developing roller 2*a* and the toner supply roller 8*a* are bent, these rollers are liable to be bent at their longitudinal central portions. In view of this property, when the communication holes 31*a* and 131*a* are provided at the longitudinal central portion of developing container 7*a* with respect to the axial develop of the developing roller 2*a*, the air can be moved efficiently through the communication holes 31*a* and 131*a*.

The toner in the enclosed space J is most liable to be leaked out from between the elastic sheet member 30*a* and the developing roller 2*a*. As in Embodiments 1 and 2, when the communication holes 31*a* and 131*a* are connected to the enclosed space J and are open to the inside of the developing container 7*a*, the leakage of the toner t in the enclosed space J is suppressed very effectively.

The constitution of the developing cartridges 5*a* to 5*d* is not limited to those in Embodiments 1 and 2 but may also be applied to the developing device fixed in the apparatus main assembly 11A and to the process cartridge using the developing cartridge and the drum cartridge in combination.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 250150/2009 filed Oct. 30, 2009 and 205557/2010 filed Sep. 14, 2010, which are hereby incorporated by reference.

What is claimed is:

1. A developing device comprising:

a developing container capable of accommodating a developer;

a developing roller, disposed at an opening of said developing container, for developing an electrostatic latent image formed on an image bearing member with the developer carried thereon;

a developer supplying roller, disposed inside said developing container, for supplying the developer to said developing roller in contact with said developing roller;

a sheet member, which is attached to said developing container at its base end portion and which contacts said developing roller at its free end portion, for preventing the developer from leaking out of said developer container;

a communication hole, provided in a wall of said developing container, for establishing communication between an inside and an outside of said developing container; and a filter member for covering said communication hole so as to prevent passage of the developer therethrough while permitting passage of air therethrough, wherein said communication hole is provided so as to be connected to an enclosed space defined by an inner wall of said developing container defining a smaller one of spaces provided by dividing said developing container by a plane including a rotation axis of said developer supplying roller and a rotational axis of said developing roller, a phantom plane which is included in the plane and extends from a surface of said developer supplying roller to the inner wall of said developer container, said sheet member, a surface of said developing roller, and a surface of said developer supplying roller.

2. A developing device according to claim 1, wherein the inner wall of said developing container defining the small space has a curved surface portion along a circumferential surface of said developer supplying roller, and wherein said communication hole is provided so as to be connected to the curved surface portion.

3. A developing device according to claim 1, wherein said communication hole is provided at a central portion of said developing container with respect to a direction rotational axis of said developing roller.

4. A developing cartridge detachably mountable to a main assembly of an image forming apparatus, said developing cartridge comprising:

a developing container capable of accommodating a developer;

a developing roller, disposed at an opening of said developing container, for developing an electrostatic latent image formed on an image bearing member with the developer carried thereon;

a developer supplying roller, disposed inside said developing container, for supplying the developer to said developing roller in contact with said developing roller;

a sheet member, which is attached to said developing container at its base end portion and which contacts said developing roller at its free end portion, for preventing the developer from leaking out of said developer container;

a communication hole, provided in a wall of said developing container, for establishing communication between an inside and an outside of said developing container; and a filter member for covering said communication hole so as to prevent passage of the developer therethrough while permitting passage of air therethrough, wherein said communication hole is provided so as to be connected to an enclosed space defined by an inner wall of said developing container defining a smaller one of spaces provided by dividing said developing container by a plane including a rotation axis of said developer supplying roller and a rotational axis of said developing roller, a phantom plane which is included in the plane and extends from a surface of said developer supplying roller to the inner wall of said developer container, said sheet member, a surface of said developing roller, and a surface of said developer supplying roller.

5. A developing cartridge according to claim 4, wherein the inner wall of said developing container defining the small space has a curved surface portion along a circumferential surface of said developer supplying roller, and wherein said communication hole is provided so as to be connected to the curved surface portion.

6. A developing cartridge according to claim 4, wherein said communication hole is provided at a central portion of said developing container with respect to a direction rotational axis of said developing roller.

7. A process cartridge detachably mountable to a main assembly of an image forming apparatus, said process cartridge comprising:

an image bearing member on which an electrostatic latent image is to be formed;

a developing container capable of accommodating a developer;

a developing roller, disposed at an opening of said developing container, for developing the electrostatic latent image with the developer carried thereon;

a developer supplying roller, disposed inside said developing container, for supplying the developer to said developing roller in contact with said developing roller;

a sheet member, which is attached to said developing container at its base end portion and which contacts said developing roller at its free end portion, for preventing the developer from leaking out of said developer container;

a communication hole, provided in a wall of said developing container, for establishing communication between an inside and an outside of said developing container; and a filter member for covering said communication hole so as to prevent passage of the developer therethrough while permitting passage of air therethrough, wherein said communication hole is provided so as to be connected to an enclosed space defined by an inner wall of said developing container defining a smaller one of spaces provided by dividing said developing container by a plane including a rotation axis of said developer supplying roller and a rotational axis of said developing roller, a phantom plane which is included in the plane and extends from a surface of said developer supplying roller to the inner wall of said developer container, said sheet member, a surface of said developing roller, and a surface of said developer supplying roller.

8. A process cartridge according to claim 7, wherein the inner wall of said developing container defining the small space has a curved surface portion along a circumferential surface of said developer supplying roller, and wherein said communication hole is provided so as to be connected to the curved surface portion.

9. A process cartridge according to claim 7, wherein said communication hole is provided at a central portion of said developing container with respect to a direction rotational axis of said developing roller.

10. An image forming apparatus comprising:

(a) an image bearing member on which an electrostatic latent image is to be formed;

(b) a developing device including: a developing container capable of accommodating a developer; a developing roller, disposed at an opening of said developing container, for developing the electrostatic latent image with the developer carried thereon; a developer supplying roller, disposed inside the developing container, for supplying the developer to said developing roller in contact with the developing roller; a sheet member, which is attached to said developing container at its base end portion and which contacts the developing roller at its free end portion, for preventing the developer from leaking out of the developer container; a communication hole, provided in a wall of said developing container, for establishing communication between an inside and an outside of said developing container; and a filter member for covering said communication hole so as to prevent passage of the developer therethrough while permitting passage of air therethrough;

wherein said communication hole is provided so as to be connected to an enclosed space defined by an inner wall of said developing container defining a smaller one of spaces provided by dividing said developing container by a plane including a rotation axis of said developer supplying roller and a rotational axis of said developing roller, a phantom plane which is included in the plane and extends from a surface of said developer supplying roller to the inner wall of said developer container, said sheet member, a surface of said developing roller, and a surface of said developer supplying roller; and (c) conveying means for conveying a recording material on which an image formed by the developer.

11. An image forming apparatus according to claim 10, wherein the inner wall of said developing container defining the small space has a curved surface portion along a circumferential surface of the developer supplying roller, and wherein said communication hole is provided so as to be connected to the curved surface portion.

12. An image forming apparatus according to claim 10, wherein said communication hole is provided at a central portion of the developing container with respect to a direction rotational axis of said developing roller.

* * * * *